US005737993A

United States Patent [19]

Cobo et al.

[11] Patent Number: 5,737,993

[45] Date of Patent: Apr. 14, 1998

[54] METHOD AND APPARATUS FOR CONTROLLING AN IMPLEMENT OF A WORK MACHINE

[75] Inventors: Michael A. Cobo, St. Charles; John D. Duffy, Peoria, both of Ill.

[73] Assignee: Caterpillar Inc., Peoria, Ill.

[21] Appl. No.: 668,783

[22] Filed: Jun. 24, 1996

[51] Int. Cl.[6] ..... F15B 13/16

[52] U.S. Cl. ..... 91/361; 91/459; 60/426; 60/327

[58] Field of Search ..... 91/361, 363 R, 91/363 A, 459; 60/459, 420, 426, 427, 327

[56] References Cited

U.S. PATENT DOCUMENTS

| | | | |
|---|---|---|---|
| 4,336,745 | 6/1982 | Lund | 91/361 X |
| 4,852,657 | 8/1989 | Hardy et al. | 91/361 X |
| 5,189,940 | 3/1993 | Hosseini et al. | 91/361 |
| 5,218,895 | 6/1993 | Lukich et al. | 91/361 |
| 5,305,681 | 4/1994 | Devier et al. | 91/361 |
| 5,333,533 | 8/1994 | Hosseini | 91/361 |
| 5,511,458 | 4/1996 | Kamata et al. | 91/361 |

OTHER PUBLICATIONS

U.S. Patent Application Serial No. 08/498,558, filed Jul. 5, 1995. Title: Control System for a Hydraulic Cylinder and Method.

*Primary Examiner*—Hoang Nguyen

*Attorney, Agent, or Firm*—David M. Masterson; Byron G. Buck, II

[57] ABSTRACT

An apparatus for controllably moving a work implement is disclosed. The implement is connected to a work machine and is moveable in response to operation of a hydraulic cylinder. The apparatus includes an operator controlled joystick. A joystick position sensor senses the position of the joystick and responsively generates an operator command signal, which is indicative of a desired velocity. A velocity sensor senses the velocity of the lift cylinder and tilt cylinders and responsively producing respective cylinder velocity signals. A microprocessor receives the cylinder velocity and operator command signals, determines the difference between the actual and desired cylinder velocity, and responsively produces an electrical valve signal in response to the velocity difference. An electrohydraulic valve receives the electrical valve signal, and controllably provides hydraulic fluid flow to the hydraulic cylinder in response to a magnitude of the electrical value signal.

15 Claims, 8 Drawing Sheets

METHOD AND APPARATUS FOR CONTROLLING AN IMPLEMENT OF A WORK MACHINE

TECHNICAL FIELD

This invention relates generally to a method and apparatus for controlling the movement of a work implement of a work machine and, more particularly, to an apparatus and method that controls the movement of the work implement based on the work implement velocity.

Background Art

Work machines such as wheel type loaders include work implements capable of being moved through a number of positions during a work cycle. Such implements typically include buckets, forks, and other material handling apparatus. The typical work cycle associated with a bucket includes sequentially positioning the bucket and associated lift arm in a digging position for filling the bucket with material, a carrying position, a raised position, and a dumping position for removing material from the bucket.

Control levers are mounted at the operator's station and are connected to an electrohydraulic circuit for moving the bucket and/or lift arms. The operator must manually move the control levers to open and close hydraulic valves that direct pressurized fluid to hydraulic cylinders which in turn cause the implement to move. For example, when the lift arms are to be raised, the operator moves the control lever associated with the lift arm hydraulic circuit to a position at which a hydraulic valve causes pressurized fluid to flow to the head end of a lift cylinder, thus causing the lift arms to rise. When the control lever returns to a neutral position, the hydraulic valve closes and pressurized fluid no longer flows to the lift cylinder.

In normal operation, the implement is often abruptly started or brought to an abrupt stop after performing a desired work cycle function, which results in rapid changes in velocity and acceleration of the bucket and/or lift arm, machine, and operator. This can occur, for example, when the implement is moved to the end of its desired range of motion. The geometric relationship between the linear movement of the tilt or lift cylinders and the corresponding angular movement of the bucket or lift arm can produce operator discomfort as a result of the rapid changes in velocity and acceleration. The forces absorbed by the linkage assembly and the associated hydraulic circuitry may result in increased maintenance and accelerated failure of the associated parts. Another potential result of the geometric relationship is excessive angular rotation of the lift arm or bucket near some linear cylinder positions which may result in poor performance.

Stresses are also produced when the machine is lowering a load and operator quickly closes the associated hydraulic valve. The inertia of the load and implement exerts forces on the lift arm assembly and hydraulic system when the associated hydraulic valve is quickly closed and the motion of the lift arms is abruptly stopped. Such stops cause increased wear on the machines and reduce operator comfort. In some situations, the rear of the machine can even be raised off of the ground.

Finally, autonomous control of earthmoving machines often require closed loop position or velocity control of corresponding subsystems to provide disturbance rejection and high levels of accuracy while under control of a high level controller. The work implement is one example of such a subsystem.

The present invention is directed to overcoming one or more of the problems as set forth above.

DISCLOSURE OF THE INVENTION

In one aspect of the present invention, an apparatus for controllably moving a work implement is disclosed. The implement (102) is connected to a work machine (104) and is moveable in response to operation of a hydraulic cylinder (106,114). The apparatus includes an operator controlled joystick (206). A joystick position sensor (220) senses the position of the joystick (206) and responsively generates an operator command signal, which is indicative of a desired velocity. A velocity sensor (216,218) senses the velocity of the lift and tilt cylinders (106,114) and responsively produces respective cylinder velocity signals. A microprocessor (208) receives the cylinder velocity and operator command signals, determines the difference between the actual and desired cylinder velocity, and responsively produces an electrical valve signal in response to the velocity difference. An electrohydraulic valve receives the electrical valve signal, and controllably provides hydraulic fluid flow to the hydraulic cylinder (106,114) in response to a magnitude of the electrical valve signal.

BRIEF DESCRIPTION OF THE DRAWING

For a better understanding of the present invention, reference may be made to the accompanying drawings in which.

BEST MODE FOR CARRYING OUT THE INVENTION

Figure 1:
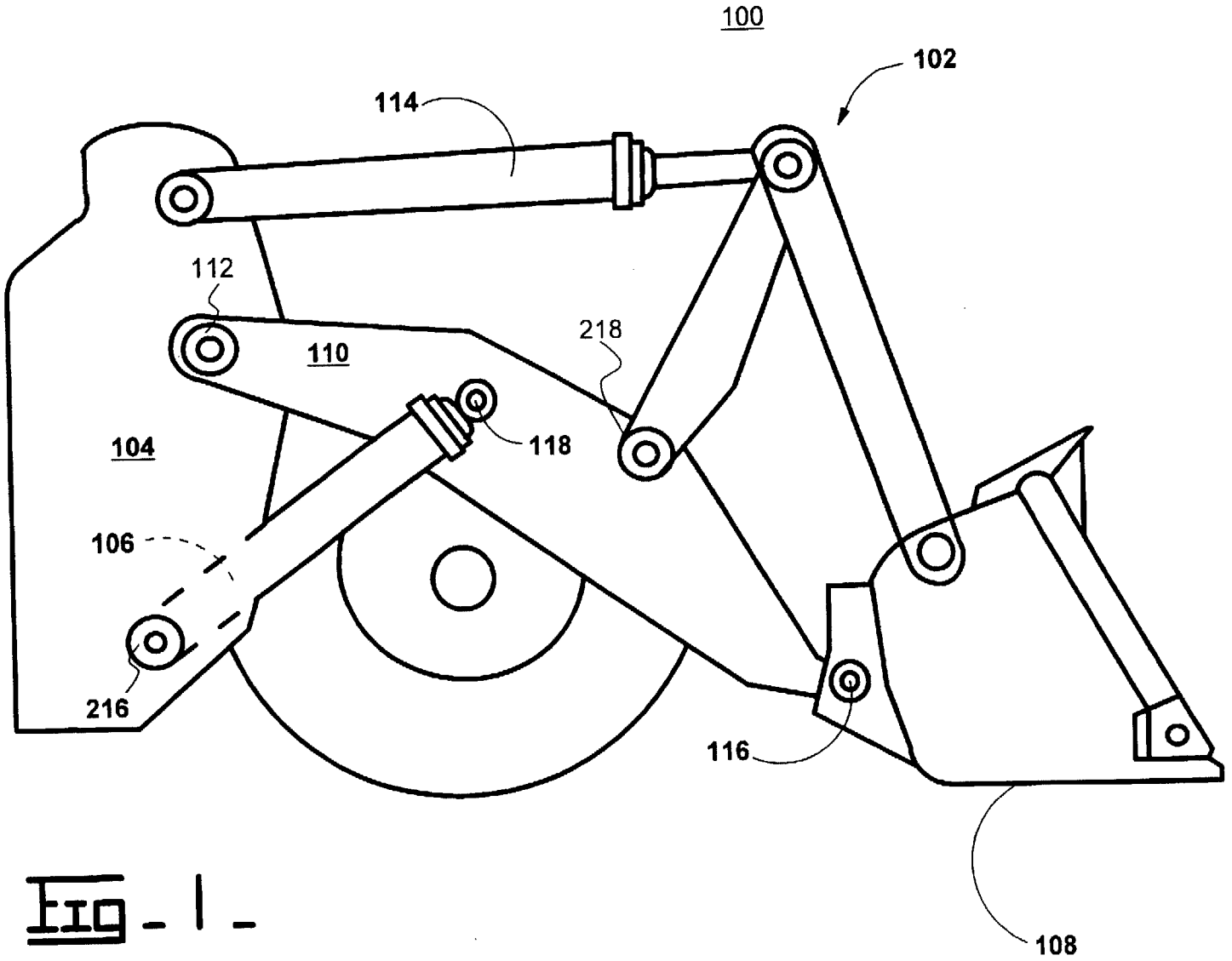
FIG. 1 is a side view of a forward portion of a loader machine or wheel type loader.

In FIG. 1, an implement control system is generally represented by the element number 100. FIG. 1 shows a forward portion of a wheel type loader machine 104 having a payload carrier in the form of a bucket 108. Although the present invention is described in relation to a wheel type loader machine, the present invention is equally applicable to many earth working machines such as track type loaders, hydraulic excavators, and other machines having similar loading implements. The bucket 108 is connected to a lift arm assembly or boom 110, which is pivotally actuated by two hydraulic lift actuators or cylinders 106 (only one of which is shown) about a boom pivot pin 112 that is attached to the machine frame. A boom load bearing pivot pin 118 is attached to the boom 110 and the lift cylinders 106. The bucket 108 is tilted by a bucket tilt actuator or cylinder 114 about a tilt pivot pin 116.

Figure 2:
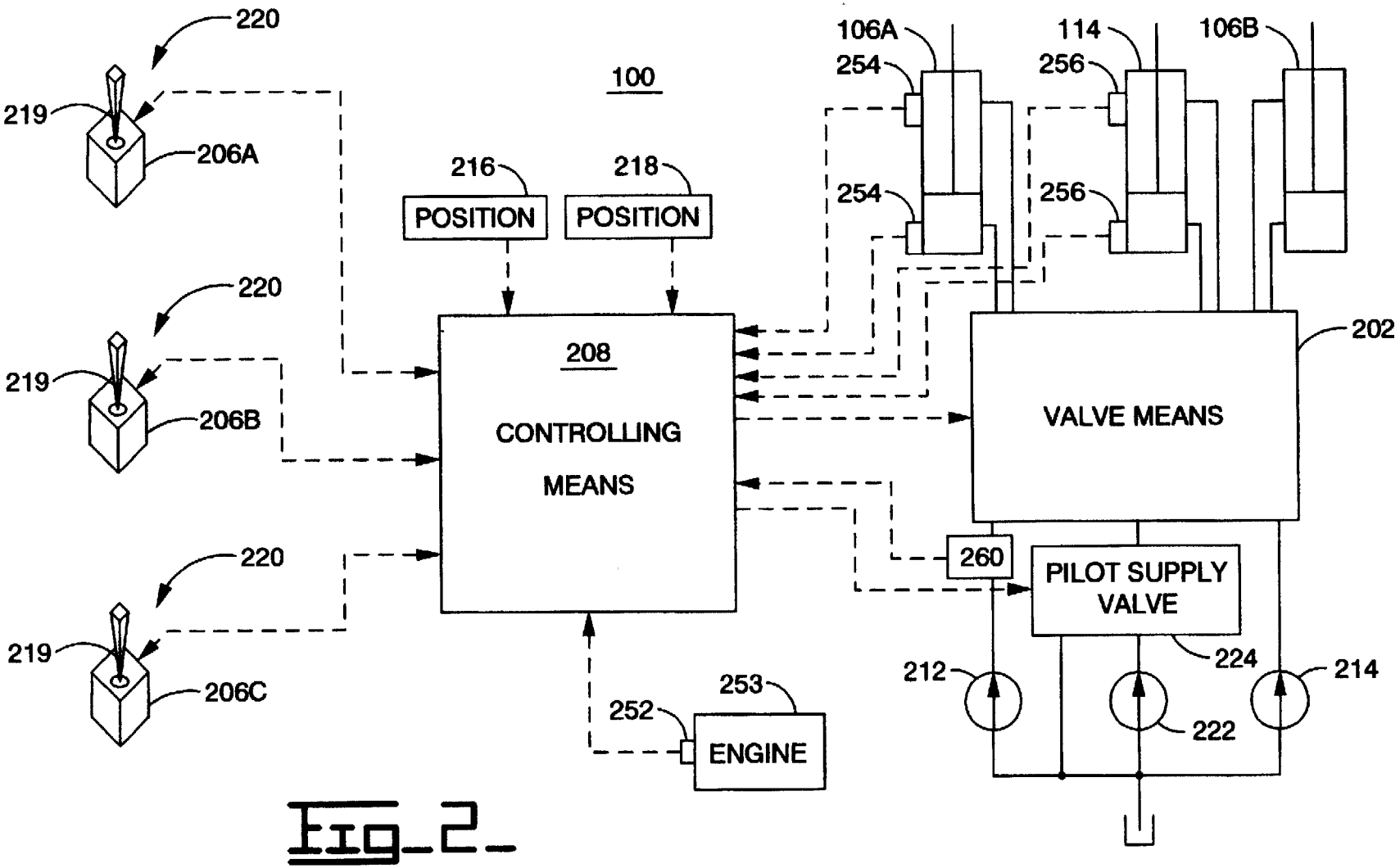
FIG. 2 is a block diagram of an electrohydraulic control system of the loader machine.

With reference to FIG. 2, the implement control system 100 as applied to a wheel type loader is diagrammatically illustrated. The implement control system is adapted to sense a plurality of inputs and responsively produce output signals which are delivered to various actuators in the control system. Preferably, the implement control system includes a microprocessor based controlling means 208.

First, second, and third joysticks 206A,206B,206C provide operator control over the work implement 102. The joysticks include a control lever 219 that has movement along a single axis. However, in addition to movement along a first axis (horizontal , the control lever 219 may also move along a second axis which is perpendicular to the horizontal axis. The first joystick 206A controls the lifting operation of the boom 110. The second joystick 206B controls the tilting operation of the bucket 108. The third joystick 206C controls an auxiliary function, such as operation of a special work tool.

A joystick position sensing means 220 senses the position of the joystick control lever 219 and responsively generates an electrical operator command signal. The operator command signal is indicative of the desired velocity of the respective hydraulic cylinder. The electrical signal is delivered to an input of the controlling means 208. The joystick position sensing means 220 preferably includes a rotary potentiometer which produces a pulse width modulated signal in response to the pivotal position of the control lever; however, any sensor that is capable of producing an electrical signal in response to the pivotal position of the control lever would be operable with the instant invention.

A cylinder velocity sensing means 216,218 senses the velocity of the lift and tilt cylinders 106,114 and responsively produces respective cylinder velocity signals. In one embodiment, the velocity sensing means 216,218 include rotary potentiometers. The rotary potentiometers produce pulse width modulated signals in response to the angular position of the boom 110 with respect to the machine and the bucket 108 with respect to the boom 110. The angular position of the boom is a function of the lift cylinder extension 106A, B, while the angular position of the bucket 108 is a function of both the tilt and lift cylinder extensions 114,106A,B. The controlling means 208 receives the respective position signals, calculates the linear position of the respective cylinder, differentiates the position signals, and produces respective cylinder velocity signals indicative of the linear velocities of the respective cylinders. Note, the function of the velocity sensing means 216,218 can readily be any other sensor which are capable of measuring, either directly or indirectly, the relative extension of a hydraulic cylinder. For example, the potentiometers could be replaced with radio frequency (RF) sensors disposed within the hydraulic cylinders.

An engine sensor 252 senses the speed of the internal combustion engine 253, and delivers an engine speed signal to the controlling means 208.

A cylinder pressure sensing means 254,256 senses the hydraulic pressure associated with the lift and tilt cylinders 106,114 and responsively delivers respective cylinder pressure signals to the controlling means 208. The cylinder pressure sensing means 254,256 includes readily available pressure sensors. The controlling means 208 receives the pressure signals, determines the associated cylinder forces, and produces respective cylinder force signals. The cylinders forces may be determined in accordance with the following equation:

(Rod End Pressure*Rod End Area)–(Head End Area*Head End Area)

A pump pressure sensing means 260 senses the hydraulic pressure associated with the main implement pump 212 and responsively delivers a pump pressure signal to the controlling means 208. The pump pressure sensing means 260 includes readily available pressure sensors. The controlling means 208 receives the pump pressure signal, and determines the hydraulic fluid flow that is available to the lift and tilt cylinders 106,114.

A valve means 202 is responsive to electrical signals produced by the controlling means and provides hydraulic fluid flow to the hydraulic cylinders 106A,B,114.

In the preferred embodiment, the valve means 202 includes four main valves (two main valves for the lift cylinders and two main valves for the tilt cylinder) and eight HYDRAC valves (two HYDRAC valves for each main valve). The main valves direct pressured fluid to the cylinders 106A,B,114 and the HYDRAC valves direct pilot fluid flow to the main valves. Each HYDRAC valve is electrically connected to the controlling means 208. An exemplary HYDRAC valve is disclosed in U.S. Pat. No. 5,366,202 issued on Nov. 22, 1994 to Stephen V. Lunzman, which is hereby incorporated by reference. Two main pumps 212,214 are used to supply hydraulic fluid to the main spools, while a pilot pump 222 is used to supply hydraulic fluid to the HYDRAC valves. An on/off solenoid valve and pressure relief valve 224 are included to control pilot fluid flow to the HYDRAC valves.

The present invention is directed toward determining an electrical valve signal magnitude to accurately control the work implement movement. The controlling means 208 preferably includes RAM and ROM modules that store software programs to carry out certain features of the present invention. Further, the RAM and ROM modules store software in a plurality of look-up tables that are used in determining the the electrical valve signal magnitude. Each look-up table corresponds to a work function that is used to control the work implement. The work functions include a lift and lower function which extends and retracts the lift hydraulic cylinders 106A, B to control the bucket height, and a dump and rack function which extends and retracts the tilt cylinder 114 to control the bucket attitude. The work function look-up tables are shown with respect to FIGS. 4–10. The number of values stored in memory is dependent upon the desired precision of the system. Interpolation may be used to determine the actual value in the event that the measured and calculated values fall between the discrete values stored in memory. The table values are based from simulation and analysis of empirical data.

The controlling means 208 receives the operator command signals and responsively produces electrical valve signals to control the respective hydraulic cylinders at a desired velocity. The valve means 202 receives the electrical valve signal, and controllably provides hydraulic fluid flow to the respective hydraulic cylinder in response to the magnitude of the electrical valve signals.

Figure 3:
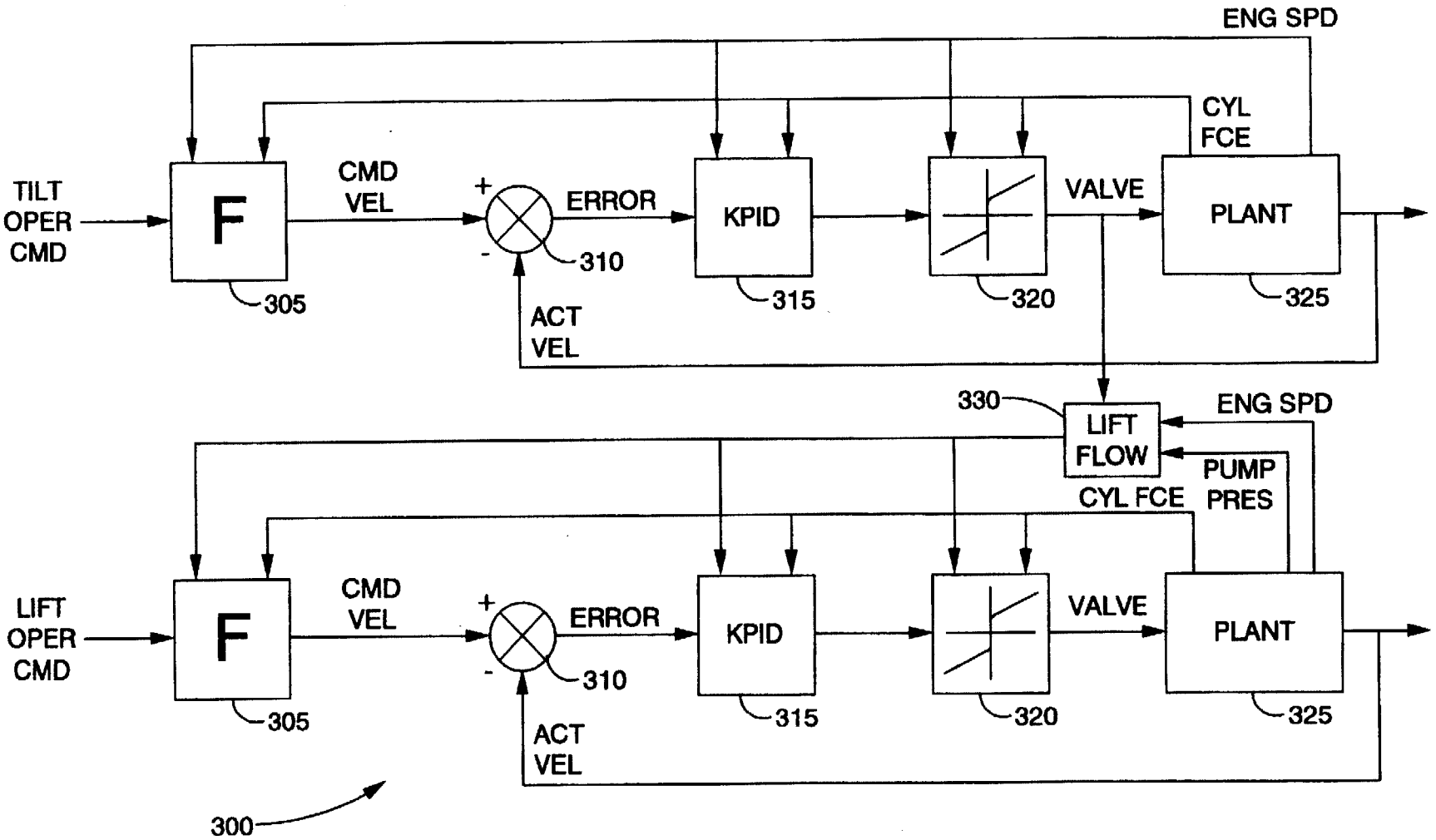
FIG. 3 is block diagram of one embodiment of a PID control system of the electrohydraulic control.

Reference is now made to FIG. 3, which shows one embodiment of the control structure of the controlling means 208. As shown, the control structure consists of a PID closed loop control system 300 that is based on velocity feedback. The PID closed loop control system 300 preferably includes two control blocks to regulate the racking and dumping functions associated with the tilt cylinder 114, and the lifting and lowering functions associated with the lift cylinders 106. The operation of the PID closed loop control system 300 is described as follows.

First, the operator command signal is converted to a command velocity signal via scaling block 305. The scaling block 305 multiplies the operator command signal by a scaling factor, later referred to as the "MAX VELOCITY FACTOR", to produce the command velocity signal. The command velocity signal is then compared to the cylinder velocity signal, which represents the actual velocity of the respective cylinder, via summing block 310, to produce a velocity error signal. A PID block 315 multiplies the corresponding velocity error signal by proportional, integral,and derivative gain values to produce a control velocity signal. A valve transformation block 320 then transforms the control velocity signal into an electrical valve signal, which is indicative of a desired stem displacement of the corresponding HYDRAC to reduce the velocity error signal to zero.

Advantageously, the scaling block values, PID gain values, and transformation block values are responsive to the corresponding cylinder forces and the flow of the hydraulic pumps 212,214. Note that, the hydraulic pump flow is proportional to engine speed. Thus, hydraulic pump flow can be easily derived from engine speed. However, the pump flow that is available to the lift hydraulic circuit is not as easily derived as that for the tilt hydraulic circuit—which is simply derived from engine speed. For example, reference is now made to FIG. 10, which shows a three-dimensional look-up table which is used to calculate available flow to the lift hydraulic circuit. The table shown in FIG. 10 stores a plurality of values, $Q_{TILT}$, representing the fluid flow associated with the tilt hydraulic circuit that corresponds to a plurality of stem displacement values, TILT STEM, and pressure differential values, ΔP. The stem displacement values directly correspond to the magnitude of the electrical valve signal that controls the stem displacement of the tilt hydraulic circuit. The pressure differential values are calculated according to the following equations:

$$P=\text{PUMP PRES}-\text{TPRES}$$

where PUMP PRES represents the pump pressure signal magnitude, and TPRES represents the hydraulic cylinder pressure signal magnitude associated with the head-end of the tilt cylinder 114 corresponding to a dumping operation or the rod-end of the tilt cylinder 114 corresponding to a racking operation. Once the fluid flow associated with the tilt hydraulic circuit, $Q_{TILT}$, has been derived, then the available fluid flow to the lift hydraulic circuit, $Q_{LIFT}$, can be derived, according to the following equation:

$$Q_{LIFT}=Q_{PUMP-QLIFT},$$

where $Q_{PUMP}$ represents the flow of the main implement pump 212.

Figure 4:
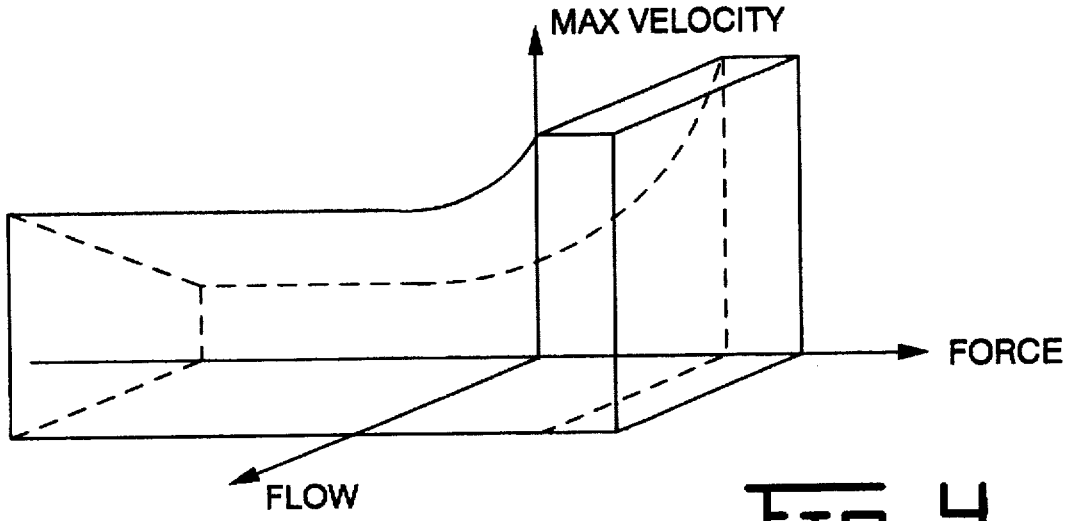
FIGS. 4–10 represent software look-up tables associated with the PID control.
Figure 5:
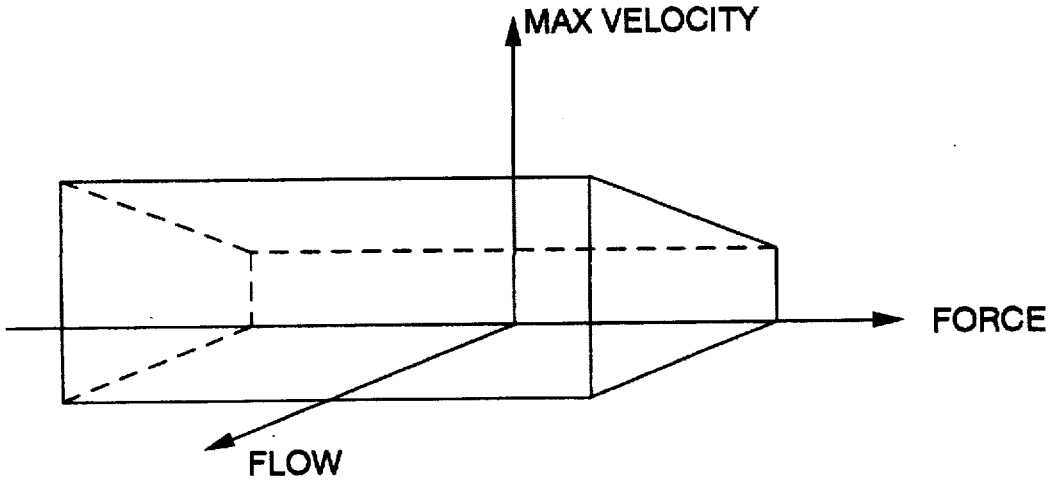

In the preferred embodiment, the scaling block values, PID gain values, and transformation block values are determined from 12 three-dimensional look-up tables (only 6 of which are shown). For example, the representative table associated with scaling block values that corresponds to the lowering and dumping operations are shown in FIG. 4. Likewise, the representative table associated with scaling block values that corresponds to the lifting and racking operations are shown in FIG. 5. Each table stores a plurality of scaling values that correspond to the cylinder forces and available pump flow. For example, a table similar to FIG. 4 is used to determine the maximum velocity command associated with the lowering operation; and, another similar table is used to determine the maximum velocity command associated with the dumping operation. Likewise, a table similar to FIG. 5 is used to determine the maximum velocity command associated with the lifting operation; and, another similar table is used to determine the maximum velocity command associated with the racking operation. Note, the scaling values are chosen, to prevent saturation of the PID control system and provide favorable lever modulation characteristics for the operator.

The PID gain values and transformation block values are determined as follows. The transformation block values include two variables: valve transform deadband and valve transform gain (VTGAIN). The valve transform deadband has different values corresponding to the lower/rack operations and the lift/dump operations. Thus, the valve transform deadband is determined from one of four tables (one table of each of rack, dump, lift and lower) that is similar to that shown in FIGS. 8 and 9. As shown, each table stores a plurality of deadband values that correspond to the cylinder forces and pump flow. The deadband values are chosen to maximally linearize the function of the hydraulic valves.

Once the valve transform deadband is determined, then the valve transform gain, VTGAIN, may be determined from the following equation:

$$(\text{MAX SPOOL DISP}-\text{DEADBAND})/\text{MAX VELOCITY FACTOR}$$

After the valve transform gain has been determined, then the PID gains may be determined. For example, the PID gains are determined by multiplying a PID variable, K, by each of the proportional, integral, and derivative gain values. The PID variable is determined by the following equation:

$$K=1/(\text{GAIN}*\text{VTGAIN})$$

Figure 6:
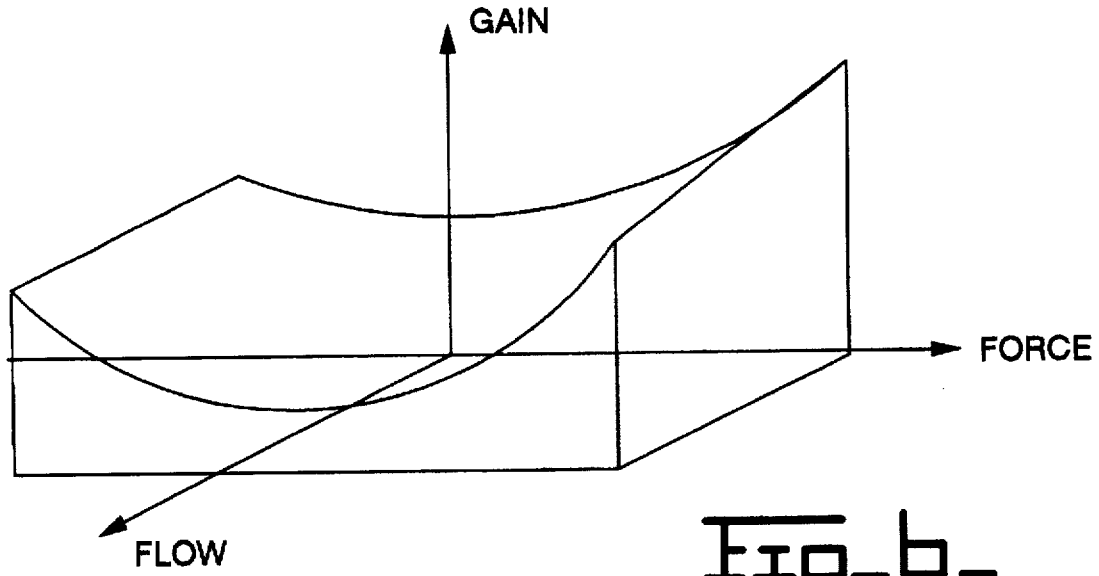
Figure 7:
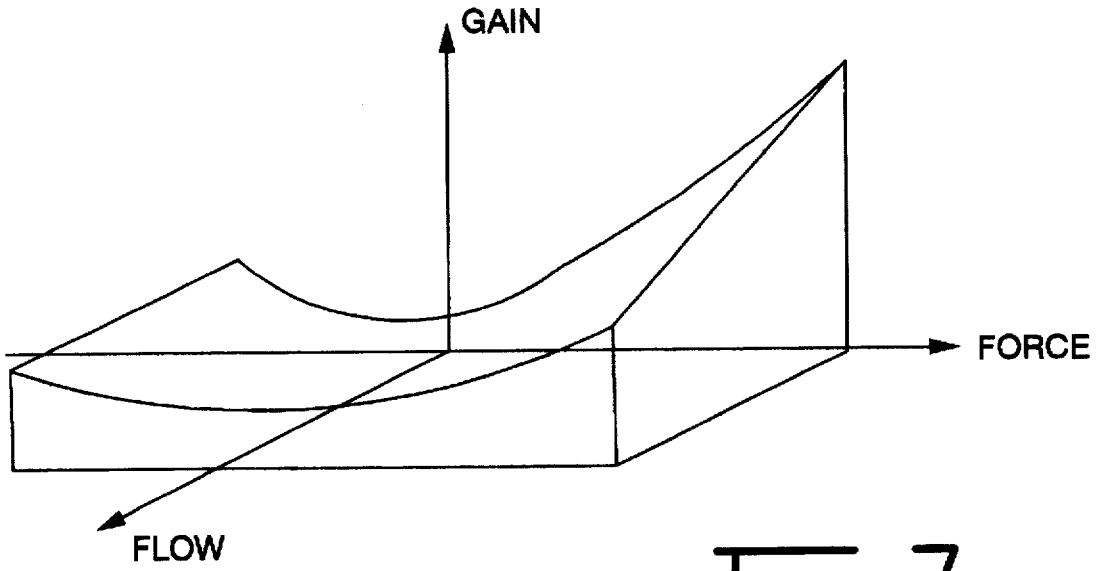
Figure 8:
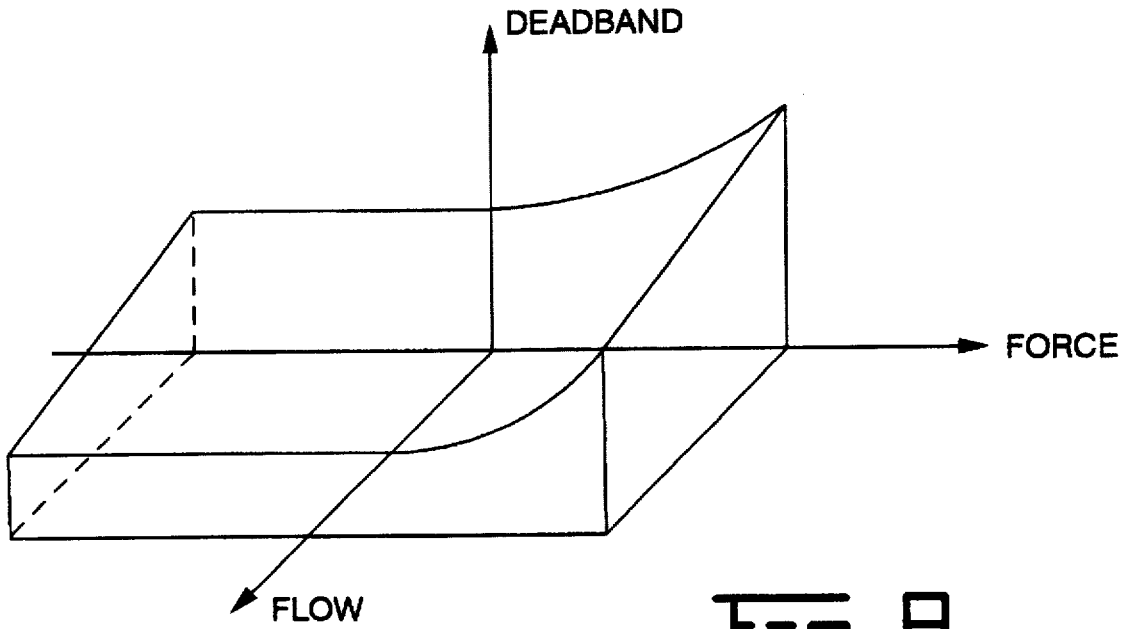
Figure 9:
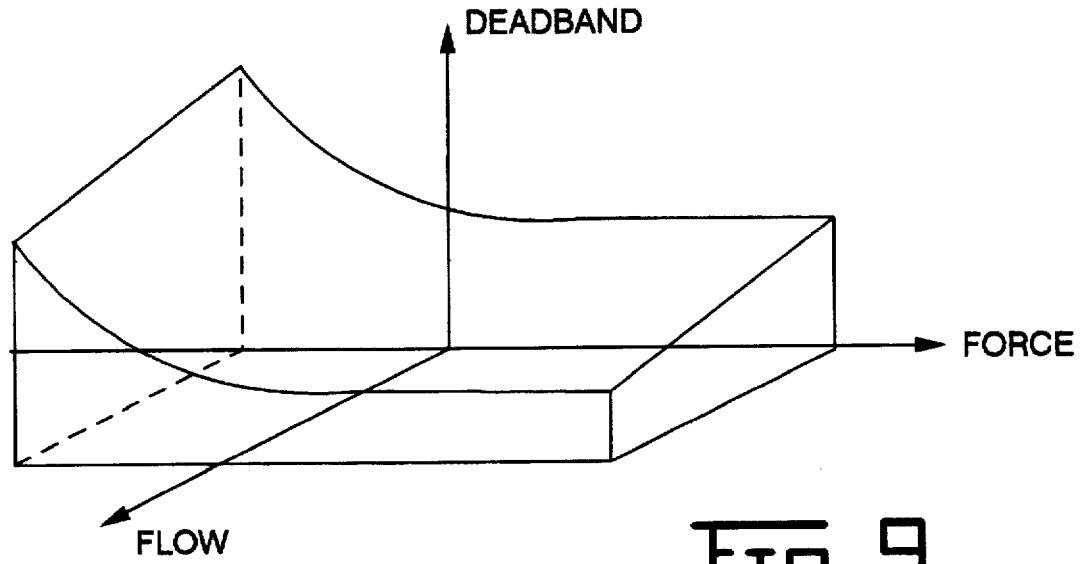
Figure 10:
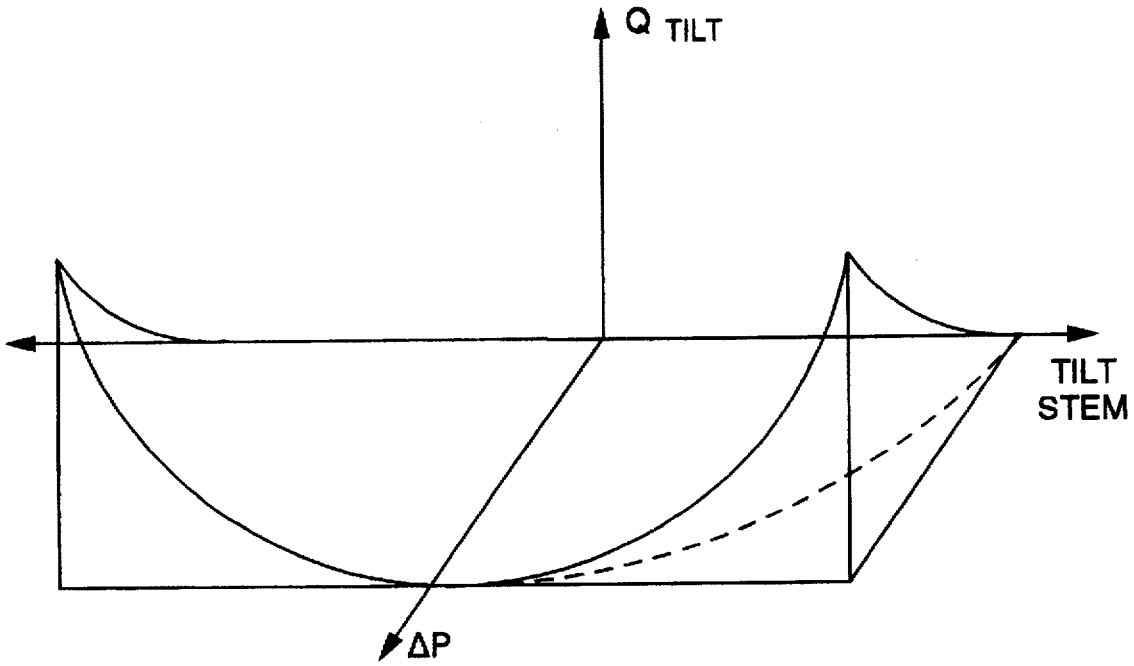

The variable GAIN is determined from one of four tables, similar to that shown in FIGS. 6 and 7. As shown, each table stores a plurality of GAIN values that correspond to the cylinder forces and pump flow. The GAIN values are chosen to further maximally linearize the function of the hydraulic valves and to provide the overall control system with a gain of one, e.g., one incremental input corresponds to an equivalent incremental output.

Figure 11:
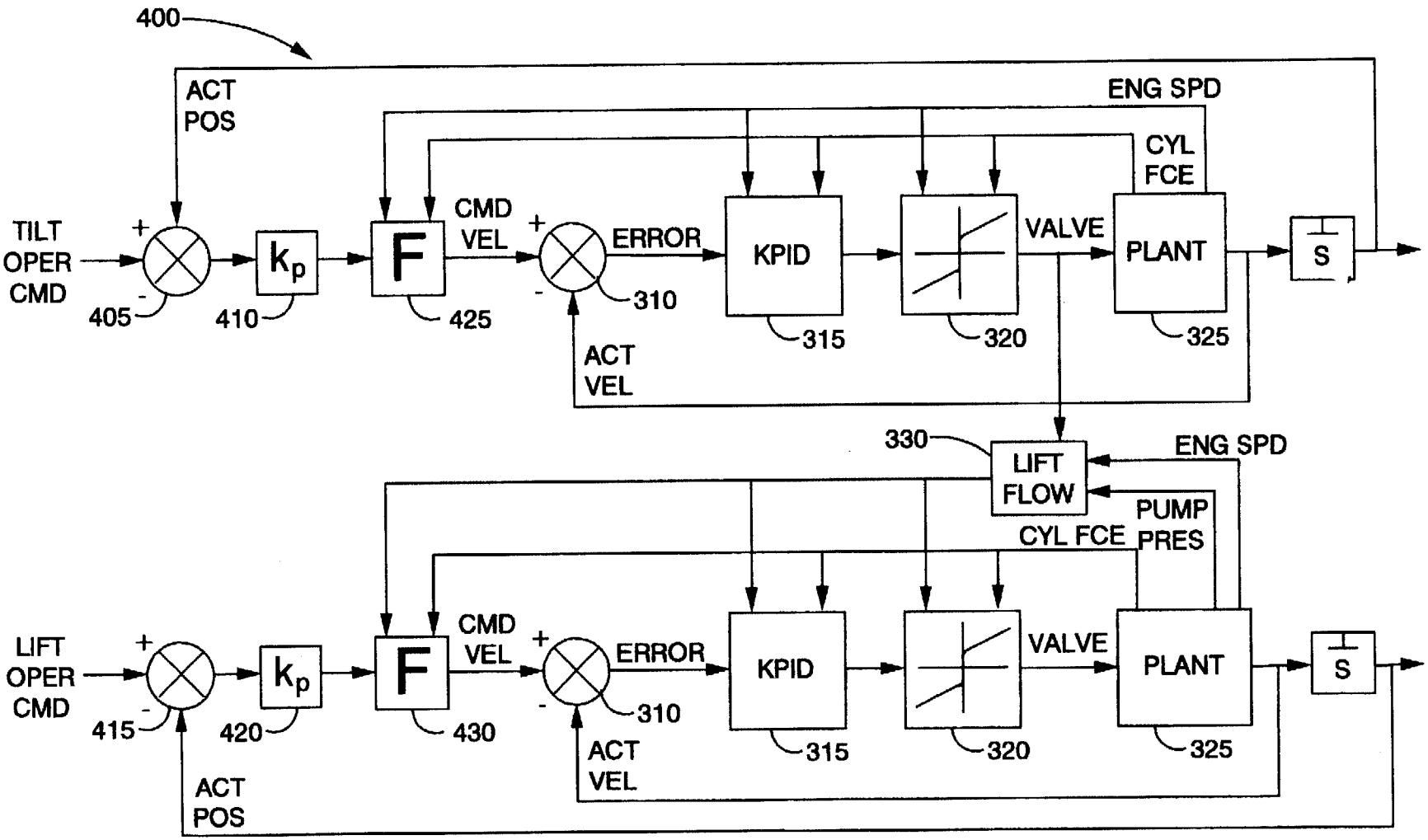
FIG. 11 is block diagram of another embodiment of a PID control system of the electrohydraulic control.

Another embodiment of a PID control system 400 is shown in FIG. 11. Here, the PID control system closes the loop on velocity, as well as, position. With such a system, the operator command is representative of a desired position, which is compared to the actual cylinder position by summing block 405,415 to produce a position error signal. The position error signal is then multiplied by a gain value, $K_p$, at block 410,420. After which, the position error signal is converted into a command velocity signal via limiting block 425,430, which limits the command velocity signal to the MAXIMUM VELOCITY FACTOR. The command velocity signal is ultimately converted into an electrical valve signal in a manner as described above. Such a FID control system is useful for autonomous control of earthmoving machines which often require closed loop position or velocity in order to provide disturbance rejection and high levels of accuracy while under control of a high level controller.

Thus, while the present invention has been particularly shown and described with reference to the preferred embodiment above, it will be understood by those skilled in the art that various additional embodiments may be contemplated without departing from the spirit and scope of the present invention.

INDUSTRIAL APPLICABILITY

Earth working machines such as wheel type loaders include work implements capable of being moved through a number of positions during a work cycle. The typical work cycle associated with a bucket includes positioning the boom and bucket in a digging position for filling the bucket with material, a carrying position, a raised position, and a dumping position for removing material from the bucket.

The present invention provides a method and apparatus that utilizes a closed-loop PID control system to accurately control the work implement velocity to operator desired velocities.

It should be understood that while the function of the preferred embodiment is described in connection with the boom and associated hydraulic circuits, the present invention is readily adaptable to control the position of implements for other types of earth working machines. For example, the present invention could be employed to control implements on hydraulic excavators, backhoes, and similar machines having hydraulically operated implements.

Other aspects, objects and advantages of the present invention can be obtained from a study of the drawings, the disclosure and the appended claims.

We claim:

1. An apparatus for controllably moving a work implement of an earth moving machine having an internal combustion engine, the work implement including a boom and a bucket being attached thereto, the work implement including a plurality of work functions that includes a lifting and lowering function where the boom is actuated by a hydraulic lift cylinder and dumping and racking function where the bucket is pivoted by a hydraulic tilt cylinder, comprising:

an operator controlled joystick;

joystick position sensing means for sensing the position of the joystick and responsively generating operator command signals;

scaling means for receiving the operator command signals and converting the operator command signals into velocity command signals;

cylinder velocity sensing means for sensing the velocity of the lift and tilt cylinders, and responsively producing respective cylinder velocity signals;

an engine sensor that senses the speed of the internal combustion engine and produces an engine speed signal;

a cylinder pressure sensing means for sensing the hydraulic pressure associated with the lift and tilt cylinders and responsively producing respective cylinder pressure signals;

controlling means for receiving the engine speed, cylinder pressure, cylinder velocity and velocity command signals; determining the difference between the cylinder velocity and velocity command signals, and responsively producing electrical valve signals in response to the velocity difference, and engine speed and cylinder pressure signals; and valve means for receiving the electrical valve signals and controllably providing hydraulic fluid flow to the respective hydraulic cylinders to move the respective hydraulic cylinders in accordance with the velocity command signals.

2. An apparatus, as set forth in claim 1, wherein the cylinder velocity sensing means includes means for sensing the linear position of the lift and tilt cylinders, producing respective cylinder position signals, and differentiating the position signals in order to produce the cylinder velocity signals.

3. An apparatus, as set forth in claim 2, wherein the control means produces a corresponding velocity error signal in response to the difference between the velocity command signal and respective cylinder velocity signal.

4. An apparatus, as set forth in claim 3, wherein the control means includes means for multiplying the corresponding velocity error signal by proportional, integral, and derivative gain values to produce a control velocity signal.

5. An apparatus, as set forth in claim 4, wherein the control means includes means for transforming the control velocity signal into an electrical valve signal.

6. An apparatus, as set forth in claim 5, including means for receiving the engine speed and pressure signals, and modifying the proportional, integral, and derivative gain values.

7. An apparatus for controllably moving a work implement of an earth moving machine having an internal combustion engine and a hydraulic fluid pump for providing fluid flow to the work implement, the work implement including a boom and a bucket being attached thereto, the work implement including a plurality of work functions that includes a lifting and lowering function where the boom is actuated by fluid flow to a hydraulic lift cylinder and a dumping and racking function where the bucket is pivoted by fluid flow to a hydraulic tilt cylinder, comprising:

at least one operator controlled joystick;

joystick position sensing means for sensing the position of the at least one joystick and responsively generating operator command signals;

cylinder position sensing means for sensing the linear position of the lift and tilt cylinders, and producing respective cylinder position signals;

means for receiving the cylinder position and operator command signals, comparing the cylinder position and operator command signals, and converting the resulting signals into velocity command signals;

cylinder velocity sensing means for sensing the velocity of the lift and tilt cylinders, and responsively producing respective cylinder velocity signals;

controlling means for receiving the cylinder velocity signals and velocity command signals, determining the difference between the cylinder velocity and velocity command signals, responsively producing an electrical tilt valve signal in response to the velocity difference and responsively producing an electrical lift valve signal in response to the velocity difference and the fluid flow provided to the tilt hydraulic cylinder; and valve means for receiving the electrical valve signals, and controllably providing hydraulic fluid flow to the respective hydraulic cylinders (106,114) to move the respective hydraulic cylinders in accordance with the velocity command signals.

8. An apparatus as set forth in claim 7, wherein the control means produces a corresponding velocity error signal in response to the difference between the velocity command signal and respective cylinder velocity signal.

9. An apparatus, as set forth in claim 8, wherein the control means includes means for multiplying the corresponding velocity error signal by proportional, integral, and derivative gain values to produce a control velocity signal.

10. An apparatus, as set forth in claim 8, wherein the control means includes means for transforming the control velocity signal into an electrical valve signal.

11. A method for controllably moving a work implement of an earth moving machine having an internal combustion engine and a hydraulic fluid pump for providing fluid flow to the work implement, the work implement including a boom and a bucket being attached thereto, the work implement including a plurality of work functions that includes a lifting and lowering function where the boom is actuated by fluid flow to a hydraulic lift cylinder and a dumping and racking function where the bucket is pivoted by fluid flow to a hydraulic tilt cylinder, the method comprising the steps of:

producing operator command signals;

receiving the operator command signals and converting the operator command signals into velocity command signals;

sensing the velocity of the lift and tilt cylinders, and responsively producing respective cylinder velocity signals;

receiving the cylinder velocity and velocity command signals, determining the difference between the cylinder velocity and velocity command signals, and responsively producing electrical valve signals in response to the velocity difference and hydraulic fluid flow available to the cylinders; and receiving the electrical valve signals, and controllably providing hydraulic fluid flow to the respective hydraulic cylinders to move the respective hydraulic cylinders in accordance with the velocity command signals.

12. A method, as set forth in claim 11, including the step of producing a velocity error signal in response to the difference between the velocity command signal and respective cylinder velocity signal.

13. A method, as set forth in claim 12, including the step of multiplying the corresponding velocity error signal by proportional, integral, and derivative gain values to produce a control velocity signal.

14. A method, as set forth in claim 13, including the step of transforming the control velocity signal into an electrical valve signal.

15. A method, as set forth in claim 14, including the steps of determining the hydraulic cylinder forces and the available hydraulic fluid flow to the cylinders, and responsively modifying the proportional, integral, and derivative gain values.

* * * * *